US006423162B1

(12) United States Patent
Schwartz et al.

(10) Patent No.: US 6,423,162 B1
(45) **Date of Patent: *Jul. 23, 2002**

(54) METHOD FOR PRODUCING DECORATIVE APPEARING BUMPER SURFACES

(75) Inventors: Frederick A. Schwartz, Woodbury; Mary Helen McCay; T. Dwayne McCay, both of Monteagle; Narendra B. Dahotre, Tullahoma; John Brice Bible, South Pittsburg; John A. Hopkins, Tullahoma, all of TN (US)

(73) Assignee: The University of Tennesse Research Corporation, Knoxville, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/347,198

(22) Filed: Jul. 2, 1999

(51) Int. Cl.[7] ..... C23C 4/06

(52) U.S. Cl. ..... 148/512; 148/525; 148/565; 219/121.82; 219/121.85; 427/554; 427/547

(58) Field of Search ..... 148/512, 525, 148/565; 219/121.82, 121.85; 427/554, 597

(56) References Cited

U.S. PATENT DOCUMENTS

| | | | |
|---|---|---|---|
| 3,705,758 A | | 12/1972 | Haskal |
| 3,848,104 A | | 11/1974 | Locke |
| 3,986,767 A | | 10/1976 | Rexer et al. |
| 4,015,100 A | | 3/1977 | Gnanamuthu et al. |
| 4,017,708 A | | 4/1977 | Engel et al. |
| 4,157,923 A | | 6/1979 | Yen et al. |
| 4,212,900 A | | 7/1980 | Serlin |
| 4,322,601 A | | 3/1982 | Serlin |
| 4,434,189 A | | 2/1984 | Zaplatynsky |
| 4,475,027 A | | 10/1984 | Pressley |
| 4,480,169 A | | 10/1984 | Macken |
| 4,495,255 A | | 1/1985 | Draper et al. |
| 4,535,218 A | | 8/1985 | Krause et al. |
| 4,617,070 A | | 10/1986 | Amende et al. |
| 4,638,163 A | | 1/1987 | Braunlich et al. |
| 4,644,127 A | | 2/1987 | La Rocca |
| 4,720,312 A | | 1/1988 | Fukuizumi et al. |
| 4,724,299 A | | 2/1988 | Hammeke |
| 4,746,540 A | | 5/1988 | Kawasaki et al. |
| 4,750,947 A | | 6/1988 | Yoshiwara et al. |
| 4,801,352 A | | 1/1989 | Piwczyk |
| 4,830,265 A | * | 5/1989 | Kennedy et al. ..... 148/525 |
| 4,839,518 A | | 6/1989 | Braunlich et al. |
| 4,847,112 A | | 7/1989 | Halleux |
| 4,898,650 A | | 2/1990 | Wu et al. |

(List continued on next page.)

FOREIGN PATENT DOCUMENTS

| | | |
|---|---|---|
| DE | 4126351 | 2/1993 |
| EP | 876870 A1 | 4/1998 |
| JP | 279692 | 11/1988 |
| JP | 401083676 A | 3/1989 |
| JP | 381082 | 4/1991 |
| JP | 3115587 A | 5/1991 |
| JP | 403115531 A | 5/1991 |
| JP | 5285686 | 11/1993 |
| SU | 1557193 | 4/1990 |
| SU | 1743770 | 6/1992 |
| WO | WO 95/21720 | 8/1995 |
| WO | WO 97/47397 | 12/1997 |

OTHER PUBLICATIONS

ASM Handbook, vol. 6, Welding, Brazing, and Soldering, 1993, pp. 806–807.

(List continued on next page.)

*Primary Examiner*—George Wyszomierski
(74) *Attorney, Agent, or Firm*—Duane Morris LLP

(57) ABSTRACT

This invention relates to a method of using a laser to produce a decorative appearance on the surface of a bumper. More specifically, the present invention relates to a laser alloying method to create a decorative alloyed layer on the surface of a bumper.

14 Claims, 2 Drawing Sheets

U.S. PATENT DOCUMENTS

| | | | | |
|---|---|---|---|---|
| 4,904,498 | A | 2/1990 | Wu | |
| 4,964,967 | A | 10/1990 | Hashimoto et al. | |
| 4,981,716 | A | 1/1991 | Sundstrom et al. | |
| 4,998,005 | A | 3/1991 | Rathi et al. | |
| 5,059,013 | A | 10/1991 | Jain | |
| 5,095,386 | A | 3/1992 | Scheibengraber | |
| 5,124,993 | A | 6/1992 | Braunlich et al. | |
| 5,130,172 | A | 7/1992 | Hicks et al. | |
| 5,147,999 | A | 9/1992 | Dekumbis et al. | |
| 5,196,672 | A | 3/1993 | Matsuyama et al. | |
| 5,208,431 | A | 5/1993 | Uchiyama et al. | |
| 5,230,755 | A | 7/1993 | Pierantoni et al. | |
| 5,247,155 | A | 9/1993 | Steen et al. | |
| 5,254,185 | A | * 10/1993 | Schade | 148/525 |
| 5,257,274 | A | 10/1993 | Barrett et al. | |
| 5,265,114 | A | 11/1993 | Sun et al. | |
| 5,267,013 | A | 11/1993 | Spence | |
| 5,290,368 | A | 3/1994 | Gavigan et al. | |
| 5,308,431 | A | 5/1994 | Maher et al. | |
| 5,314,003 | A | 5/1994 | Mackay | |
| 5,319,195 | A | 6/1994 | Jones et al. | |
| 5,322,436 | A | 6/1994 | Horng et al. | |
| 5,331,466 | A | 7/1994 | Van Saarloos | |
| 5,352,538 | A | 10/1994 | Takeda et al. | |
| 5,387,292 | A | 2/1995 | Morishige et al. | |
| 5,406,042 | A | 4/1995 | Engelfriet et al. | |
| 5,409,741 | A | 4/1995 | Laude | |
| 5,411,770 | A | 5/1995 | Tsai et al. | |
| 5,430,270 | A | 7/1995 | Findlan et al. | |
| 5,446,258 | A | 8/1995 | Mordike | |
| 5,449,536 | A | 9/1995 | Funkhouser et al. | |
| 5,466,906 | A | 11/1995 | McCune, Jr. et al. | |
| 5,484,980 | A | 1/1996 | Pratt et al. | |
| 5,486,677 | A | 1/1996 | Maischner et al. | |
| 5,491,317 | A | 2/1996 | Pirl | |
| 5,514,849 | A | 5/1996 | Findlan et al. | |
| 5,530,221 | A | 6/1996 | Benda et al. | |
| 5,546,214 | A | 8/1996 | Black et al. | |
| 5,563,095 | A | 10/1996 | Frey | |
| 5,614,114 | A | 3/1997 | Owen | |
| 5,643,641 | A | 7/1997 | Turchan et al. | |
| 5,659,479 | A | 8/1997 | Duley et al. | |
| 5,874,011 | A | 2/1999 | Ehrlich | |
| 5,985,056 | A | * 11/1999 | McCay et al. | 148/525 |
| 6,144,012 | A | * 11/2000 | Dulaney et al. | 148/525 |
| 6,284,067 | B1 | * 9/2001 | Schwartz et al. | 148/525 |

OTHER PUBLICATIONS

Ayers, et al.; "A Laser Processing Technique for Improving the Wear Resistance of Metals," *Journal of Metals,* Aug. 1981, 19–23.

Belvaux, et al.; "A Method for Obtaining a Uniform Non–Gaussian Laser Illumination," *Optics Communications,* vol. 15, No. 2, Oct. 1975, 193–195.

Bett, et al.; "Binary phase zone–plate arrays for laser–beam spatial–intensity distribution conversion," *Applied Optics,* vol. 34, No. 20, Jul. 10, 1995, 4025–4036.

Bewsher, et al.; "Design of single–element laser–beam shape projectors," Applied *Optics,* vol. 35, No. 10, Apr. 1, 1996, 1654–1658.

Breinan, et al.; "Processing material with lasers," *Physics Today,* Nov. 1976, 44–50.

Bruno, et al.; "Laserbeam Shaping for Maximum Uniformity and Maximum Loss, A Novel Mirror Arrangement Folds the Lobes of a Multimode Laserbeam Back onto its Center," *Lasers & Applications,* Apr. 1987, 91–94.

Chen, et al.; "The Use of a Kaleidoscope to Obtain Uniform Flux Over a Large Area in a Solar or Arc Imaging Furnace," *Applied Optics,* vol. 2, No. 3, Mar. 1963, 265–271.

Christodoulou, et al.; "Laser surface melting of some alloy steels," *Metals Technology,* Jun. 1983, vol. 10, 215–222.

Cullis, et al.; "A device for laser beam diffusion and homogenisation," J. Phys.E:Sci. Instrum., vol. 12, 1979, 668–689.

Dahotre, et al., "Development of microstructure in laser surface alloying of steel with chromium," *Journal of Materials Science,* vol. 25, 1990, 445–454.

Dahotre, et al., "Laser Surface Melting and Alloying of Steel with Chromium," *Laser Material Processing III,* 1989, 3–19.

Fernelius, et al.; "Design and Testing of a Refractive Laser Beam Homogenizer," *Airforce Writing Aeronautical Laboratories Report,* (AFWAL–TR–84–4042), Sep. 1984, 46 pages.

Frieden; "Lossless Conversion of a Plane Laser Wave to a Plane Wave of Uniform Irradiance," *Applied Optics,* vol. 4, No. 11, Nov. 1965, 1400–1403.

Galletti, et al.; "Transverse–mode selection in apertured super–Gaussian resonators: an experimental and numerical investigation for a pulsed $CO_2$ Doppler lidar transmitter," *Applied Optics,* vol. 36, No. 6, Feb. 20, 1997, 1269–1277.

Gori, et al.; "Shape–invariance range of a light beam," *Optics Letters,* vol. 21, No. 16, Aug. 15, 1996, 1205–1207.

Grojean, et al.; "Production of flat top beam profiles for high energy lasers," Rev. Sci. Instrum. 51(3), Mar. 1980, 375–376.

Hella, "Material Processing with High Power Lasers," *Optical Engineering,* vol. 17, No. 3, May–Jun. 1978, 198–201.

Ignatiev, et al.; "Real–time pyrometry in laser machining," *Measurement and Science Technology,* vol. 5, No. 5, 563–573.

"Laser Removing of Lead–Based Paint" Illinois Department of Transportation, Jun. 1992, 26 pages.

Jones, et al.; "Laser–beam analysis pinpoints critical parameters," *Laser Focus World,* Jan. 1993, 123–130.

Khanna, et al.; "The Effect of Stainless Steel Plasma Coating and Laser Treatment on the Oxidation Resistance of Mild Steel," *Corrosion Science,* vol. 33, No. 6, 1992, 949–958.

"New Products" *Laser Focus World,* Aug. 1996, 173.

Lugscheider, et al.;"A Comparison of the Properties of Coatings Produced by Laser Cladding and Conventional Methods," *Surface Modification Technologies V,* The Institute of Materials, 1992, 383–400.

Manna, et al.; "A One–dimensional Heat Transfer Model for Laser Surface Alloying of Chromium on Copper Substrate," *Department of Metallurgical & Materials Engineering,* Indian Institute of Technology, vol. 86, N. 5, May 1995, 362–364.

Mazille, et al.; "Surface Alloying of Mild Steel by Laser Melting of Nickel and Nickel/Chromium Precoatings," *Materials Performance Maintenance,* Aug. 1991, 71–83.

Molian; "Characterization of Fusion Zone Defects in Laser Surface Alloying Applications," *Scripta Metallurgica,* vol. 17, 1983, 1311–1314.

Molian; "Effect of Fusion Zone Shape on the Composition Uniformity of Laser Surface Alloyed Iron," *Scripta Metallurgica,* vol. 16, 1982, 65–68.

Molian; Structure and hardness of laser–processed Fe–0.2%C–5%Cr and Fe–0.2%C–10%Cr alloys; *Journal of Materials Science,* vol. 20, 1985, 2903–2912.

"Line–Focussing Optics for Multiple–Pass Laser Welding," NASA Tech Briefs MFS–29976, date unknown.
"Cylindrical Lenses," *Newport Technical Guide,* date unknown, N–65.
"Fused Silica Cylindrical Lenses," *Newport Technical Guide,,* date unknown, N–68.
Oswald, et al.; "Measurement and modeling of primary beam shape in an ion microprobe mass analyser," IOP Publishing Ltd., 1990, 255–259.
Renaud, et al., "Surface Alloying of Mild Steel by Laser Melting of an Electroless Nickel Deposit Containing Chromium Carbides," *Materials & Manufacturing Processes,* 6(2), 1991, 315–330.
Smurov, et al.; "Peculiarities of pulse laser alloying: Influence of spatial distribution of the beam," J. Appl. Phys. 71(7), Apr. 1, 1992, 3147–3158.
"Spawr Integrator," Spawr Optical Research, Inc., Data Sheet No. 512, Jun. 1986.
Veldkamp, et al.; "Beam profile shaping for laser radars that use detector arrays," *Applied Optics,* vol. 21, No. 2, Jan. 15, 1982, 345–358.
Veldkamp; "Laser Beam Profile Shaping with Binary Diffraction Gratings," *Optics communications,* vol. 38, No. 5,6, Sep. 1, 1981, 381–386.
Veldkamp; "Laser beam profile shpaing with interlaced binary diffraction gratings," *Applied Optics,* vol. 21, No. 17, Sep. 1, 1982, 3209–3212.
Veldkamp; "Technique for generating focal–plane flattop laser–beam profiles," Rev. Sci. Instru., vol. 53, No. 3, Mar. 1982, 294–297.
Walker, et al.; "Laser surface alloying of iron and 1C–1·4Cr steel with carbon," *Metals Technology,* vol. 11, Sep. 1984, 5 pages.
Walker, et al.; "The laser surface–alloying of iron with carbon," Journal of Material Science vol. 20, 1985, 989–995.
Wei, et al.; "Investigation of High–Intensity Beam Characteristics on Welding Cavity Shape and Temperature Distribution," Journal of Heat Transfer, vol. 112, Feb. 1990, 163–169.
Charschan, "Laser in industry," *Laser Processing Fundamentals,* (Van Nostrand Reinhold Company), Chapter 3, Sec. 3–1, 139–145.
Fernelius, et al; "Calculations Used in the Design of a Refractive Laser Beam Homogenizer," *Airforce Writing Aeronautical Laboratories Report,* (AFWAL–TR–84–4047), Aug. 1984, 18 pages.
Jain, et al.; "Laser Induced Surface Alloy Formation and Diffusion of Antimony in Aluminum," *Nuclear Instruments and Method,* vol. 168, 275–282, 1980.
Molian; "Estimation of cooling rates in laser surface alloying processes," Journal of Materials Science Letters, vol. 4, 1985, 265–267.
"High Power CW Nd:YAG Laser Transformation Hardening," Hobart Laser Products, 2 pages.

* cited by examiner

METHOD FOR PRODUCING DECORATIVE APPEARING BUMPER SURFACES

BACKGROUND OF THE INVENTION

1. Field of the Invention

This invention relates to a method of using a laser to produce a decorative appearance on the surface of a bumper. More specifically, the present invention relates to a laser alloying method to create a decorative alloyed layer on the surface of a bumper.

2. Description of the Prior Art

Automotive bumpers are often chrome plated in order to give them a shiny appearance. Such chrome plating is subject to corrosion and/or pitting. The present invention provides a method for producing a bumper with an alloyed layer that has an appearance equivalent to that of chrome and resistance to environmental conditions equivalent to that of stainless steel.

SUMMARY OF THE INVENTION

The present invention is directed to a process or method for producing a decorative appearing bumper surface. The present invention comprises applying a layer of precursor comprising chromium or nickel to a metallic bumper surface. The precursor layer is applied to have a thickness in the range of 50–75 microns.

The present invention further comprises irradiating the surface of a bumper with a laser beam while the bumper is moved relative to the laser beam in a preselected pattern. The irradiation occurs at a sufficient energy level and for a sufficient time to produce an alloyed surface layer on the bumper. The alloyed surface layer has an environmental resistance equivalent to that of stainless steel and a shininess equivalent to that of chrome.

DESCRIPTION OF THE PREFERRED EMBODIMENTS

The present invention is directed toward a method for producing a decorative appearing bumper surface. This method comprises applying a layer of precursor 21 comprising chromium or nickel to a metallic bumper surface 26, as shown in FIG. 2 and in Block 10 of FIG. 1. The precursor has a thickness in the range of 50–75 microns.

Figure 1:
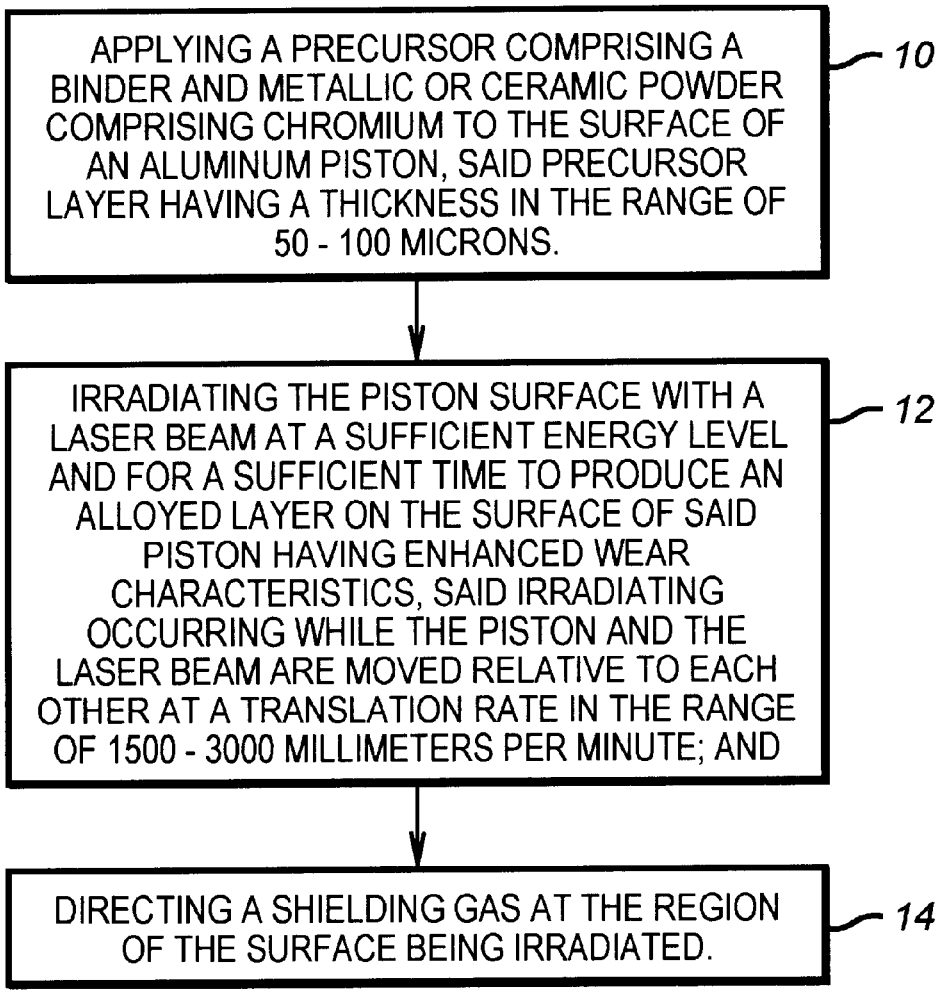
FIG. 1 is a block diagram depicting the method of the present invention.
Figure 2:
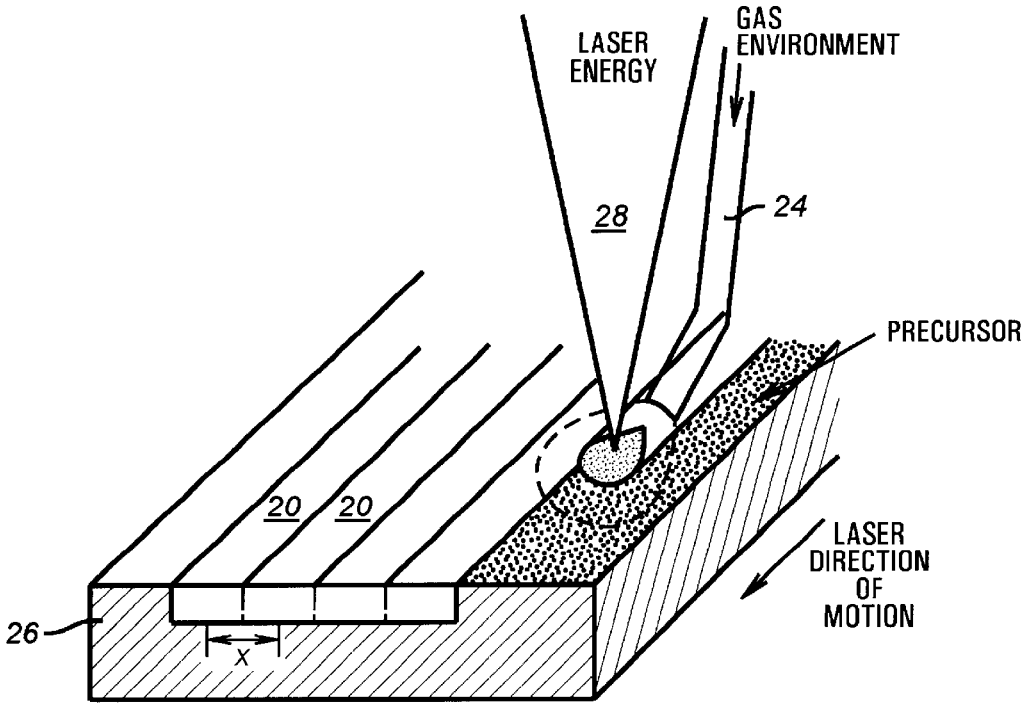
FIG. 2 is an isometric view of an apparatus suitable for practicing the present invention.

The invention further comprises irradiating the surface of the bumper with the laser beam 28 while the bumper surface is moved relative to the laser beam, as shown in FIG. 2 and in Block 12 of FIG. 1. In a preferred embodiment, the bumper is moved relative to the laser at a translation rate of 4500–9000 millimeters per minute. In another preferred embodiment, the bumper is moved relative to the laser beam along a linear track 20, as shown in FIG. 2.

Figure 3:
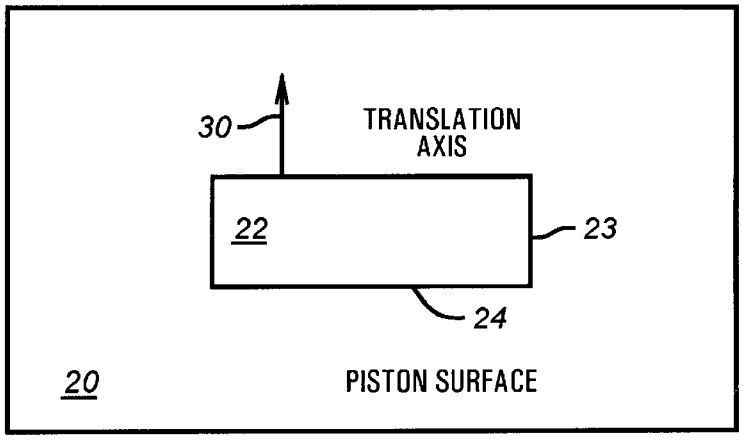
FIG. 3 is an enlarged top view of a laser beam cross section for use in the present invention.

In a preferred embodiment, the laser beam 22 has a rectangular cross sectional area comprising two shorter sides 25 and two longer sides 23, as shown in FIG. 3. In another preferred embodiment, the longer sides of the rectangular cross sectional area have a length of at least four millimeters and the shorter sides of the rectangular cross sectional area have a length of at least 0.6 millimeters. A rectangular beam profile having the dimensions described above can be achieved by aligning a spherical lens closest to the beam, a second cylindrical lens closest to the substrate and a first cylindrical lens between the spherical lens and the second cylindrical lens. The spherical lens should have a focal length of 101.6 millimeters and the first cylindrical lens should have a focal length of 203.2 millimeters. The second cylindrical lens should have a focal length of 152.4 millimeters. The spherical lens and the first cylindrical lens should be spaced apart by five millimeters. The first cylindrical lens and second cylindrical lens should be spaced apart 15 millimeters. In another preferred embodiment, the direction of laser beam translation relative to the bumper surface is perpendicular to the larger sides of the rectangular beam cross section.

The term "track index", as used herein, refers to the center to center distance between adjacent laser beam irradiation tracks. In a preferred embodiment, the track index, x, is less than or equal to the width of the laser beam, as shown in FIG. 2. This ensures that there are no nonirradiated regions between adjacent tracks.

The irradiating takes place at a sufficient energy level and for a sufficient time to produce a surface alloy layer having an environmental resistance equivalent to the environmental resistance of stainless steel. The irradiation also takes place at a sufficient energy level and for a sufficient time to produce a surface alloy layer having a shininess equivalent to the shininess of chrome, as shown in Block 12 of FIG. 1. In a preferred embodiment, the irradiating is performed at a laser power density in a range of 45–55 kilowatts/cm$^2$. In a preferred embodiment, the irradiating step is repeated along at least one parallel track 20 adjacent to the most recently irradiated track, as shown in FIG. 2.

In a preferred embodiment, gas 24 is directed at the region of the surface being irradiated by the laser beam, as shown in FIG. 2, and in Block 14 of FIG. 1. In a preferred embodiment, the gas is nitrogen or argon. In a preferred embodiment, the irradiating step and the directing gas step are repeated along at least one parallel track adjacent to the most recently irradiated track, as shown in FIG. 2, and in Block 16 of FIG. 1.

The foregoing disclosure and description of the invention are illustrative and explanatory. Various changes in the size, shape, and materials, as well as in the details of the illustrative construction may be made without departing from the spirit of the invention.

What is claimed is:

1. A method for producing a decorative appearing bumper surface comprising:

a. applying a layer of precursor comprising chromium or nickel to a metallic bumper surface, said precursor having a thickness in the range of 50–75 microns; and b. irradiating the surface of the bumper with a laser beam having a rectangular cross sectional area while the bumper is moved relative to the laser beam, said irradiating taking place at a sufficient energy level and for a sufficient time to produce a surface alloy layer.

2. The method of claim 1 further comprising directing a gas at the region of the surface being irradiated by the laser beam.

3. The method of claim 2 wherein said directing gas directs nitrogen or argon at the surface.

4. The method of claim 1 wherein the bumper is moved relative to the laser along a linear track at a translation rate of 4500–9000 millimeters per minute.

5. The method of claim 1 wherein the longer sides of said cross sectional area have a length of at least four millimeters and the shorter sides of said rectangular cross sectional area have a length of at least 0.6 millimeters.

6. The method of claim 5 further comprising repeating step b along at least one parallel track adjacent to the most recently irradiated track.

7. The method of claim 1, wherein said irradiating is performed at a laser power density in the range of 45–55 kilowatts/$cm^2$.

8. A method for producing a decorative appearing bumper surface comprising:

applying a layer of precursor comprising chromium or nickel to a metallic bumper surface, said precursor having a thickness in the range of 50–75 microns;

b. irradiating the surface of the bumper with a laser beam having a rectangular cross sectional area while the bumper is moved relative to the laser beam at a translation rate of 4500–9000 millimeters per minute, said irradiating taking place at a sufficient energy level and for a sufficient time to produce a surface alloy layer; and c. directing a gas at the region of the surface being irradiated.

9. The method of claim 8 wherein said bumper is moved relative to said laser beam along a linear track.

10. The method of claim 9 further comprising repeating steps b and c along at least one parallel track adjacent to the most recently irradiated track.

11. The method of claim 8 wherein the longer sides of said cross sectional area have a length of at least four millimeters and the shorter sides of said rectangular cross sectional area have a length of at least 0.6 millimeters.

12. The method of claim 8 wherein said directing gas directs nitrogen or argon at the surface.

13. Method for producing a decorative appearing bumper surface comprising:

a. applying a layer of precursor comprising chromium or nickel to a metallic bumper surface, said precursor having a thickness in the range of 50–75 microns;

b. irradiating the surface of the bumper with a laser beam having a rectangular cross sectional area while the bumper is moved along a linear track relative to the laser beam at a translation rate of 4500–9000 millimeters per minute, said irradiating taking place at a sufficient energy level and for a sufficient time to produce a surface alloy layer;

c. directing argon or nitrogen gas at the region of the surface being irradiated; and d. repeating steps b and c along at least one parallel track adjacent to the most recently irradiated track, wherein the center to center distance between adjacent tracks is less than or equal to the width of the laser beam.

14. The method of claim 13, wherein said irradiating is performed at a laser power density in the range of 45–55 kilowatts/$cm^2$.

* * * * *

UNITED STATES PATENT AND TRADEMARK OFFICE

CERTIFICATE OF CORRECTION

PATENT NO. : 6,423,162 B1
APPLICATION NO. : 09/347198
DATED : July 23, 2002
INVENTOR(S) : Frederick A. Schwartz et al.

It is certified that error appears in the above-identified patent and that said Letters Patent is hereby corrected as shown below:

The title page should be deleted to appear as per attached title page.

The sheets of drawings consisting of figures 1 and 3 should be deleted to appear as per attached sheets.

(12) United States Patent
Schwartz et al.

(10) Patent No.: US 6,423,162 B1
(45) **Date of Patent: *Jul. 23, 2002**

(54) METHOD FOR PRODUCING DECORATIVE APPEARING BUMPER SURFACES

(75) Inventors: Frederick A. Schwartz, Woodbury; Mary Helen McCay; T. Dwayne McCay, both of Monteagle; Narendra B. Dahotre, Tullahoma; John Brice Bible, South Pittsburg; John A. Hopkins, Tullahoma, all of TN (US)

(73) Assignee: The University of Tennesse Research Corporation, Knoxville, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/347,198

(22) Filed: Jul. 2, 1999

(51) Int. Cl.[7] ..... C23C 4/06

(52) U.S. Cl. ..... 148/512; 148/525; 148/565; 219/121.82; 219/121.85; 427/554; 427/547

(58) Field of Search ..... 148/512, 525, 148/565; 219/121.82, 121.85; 427/554, 597

(56) References Cited

U.S. PATENT DOCUMENTS

| | | | | |
|---|---|---|---|---|
| 3,705,758 | A | | 12/1972 | Haskal |
| 3,848,104 | A | | 11/1974 | Locke |
| 3,986,767 | A | | 10/1976 | Rexer et al. |
| 4,015,100 | A | | 3/1977 | Gnanamuthu et al. |
| 4,017,708 | A | | 4/1977 | Engel et al. |
| 4,157,923 | A | | 6/1979 | Yen et al. |
| 4,212,900 | A | | 7/1980 | Serlin |
| 4,322,601 | A | | 3/1982 | Serlin |
| 4,434,189 | A | | 2/1984 | Zaplatynsky |
| 4,475,027 | A | | 10/1984 | Pressley |
| 4,480,169 | A | | 10/1984 | Macken |
| 4,495,255 | A | | 1/1985 | Draper et al. |
| 4,535,218 | A | | 8/1985 | Krause et al. |
| 4,617,070 | A | | 10/1986 | Amende et al. |
| 4,638,163 | A | | 1/1987 | Braunlich et al. |
| 4,644,127 | A | | 2/1987 | La Rocca |
| 4,720,312 | A | | 1/1988 | Fukuizumi et al. |
| 4,724,299 | A | | 2/1988 | Hammeke |
| 4,746,540 | A | | 5/1988 | Kawasaki et al. |
| 4,750,947 | A | | 6/1988 | Yoshiwara et al. |
| 4,801,352 | A | | 1/1989 | Piwczyk |
| 4,830,265 | A | * | 5/1989 | Kennedy et al. ..... 148/525 |
| 4,839,518 | A | | 6/1989 | Braunlich et al. |
| 4,847,112 | A | | 7/1989 | Halleux |
| 4,898,650 | A | | 2/1990 | Wu et al. |

(List continued on next page.)

FOREIGN PATENT DOCUMENTS

| | | | |
|---|---|---|---|
| DE | 4126351 | | 2/1993 |
| EP | 876870 | A1 | 4/1998 |
| JP | 279692 | | 11/1988 |
| JP | 401083676 | A | 3/1989 |
| JP | 381082 | | 4/1991 |
| JP | 3115587 | A | 5/1991 |
| JP | 403115531 | A | 5/1991 |
| JP | 5285686 | | 11/1993 |
| SU | 1557193 | | 4/1990 |
| SU | 1743770 | | 6/1992 |
| WO | WO 95/21720 | | 8/1995 |
| WO | WO 97/47397 | | 12/1997 |

OTHER PUBLICATIONS

ASM Handbook, vol. 6, Welding, Brazing, and Soldering, 1993, pp. 806–807.

(List continued on next page.)

*Primary Examiner*—George Wyszomierski
(74) *Attorney, Agent, or Firm*—Duane Morris LLP

(57) ABSTRACT

This invention relates to a method of using a laser to produce a decorative appearance on the surface of a bumper. More specifically, the present invention relates to a laser alloying method to create a decorative alloyed layer on the surface of a bumper.

14 Claims, 2 Drawing Sheets

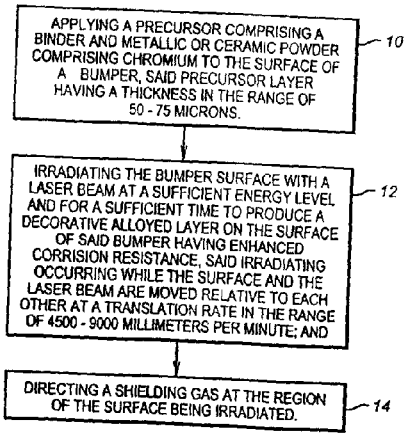

UNITED STATES PATENT AND TRADEMARK OFFICE

CERTIFICATE OF CORRECTION

PATENT NO. : 6,423,162 B1
APPLICATION NO. : 09/347198
DATED : July 23, 2002
INVENTOR(S) : Frederick A. Schwartz et al.

It is certified that error appears in the above-identified patent and that said Letters Patent is hereby corrected as shown below:

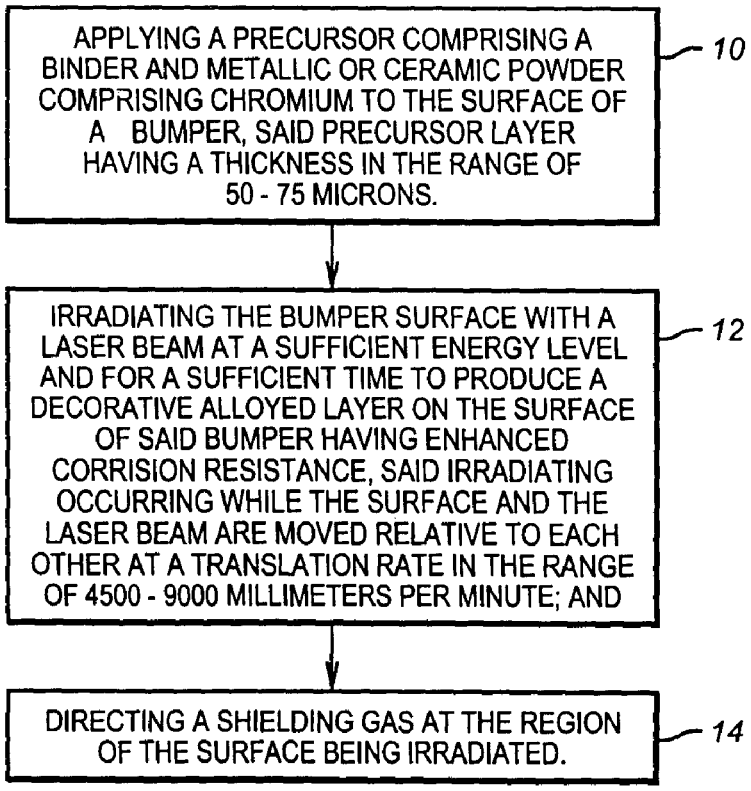

*FIG. 1*

UNITED STATES PATENT AND TRADEMARK OFFICE

CERTIFICATE OF CORRECTION

PATENT NO. : 6,423,162 B1
APPLICATION NO. : 09/347198
DATED : July 23, 2002
INVENTOR(S) : Frederick A. Schwartz et al.

It is certified that error appears in the above-identified patent and that said Letters Patent is hereby corrected as shown below:

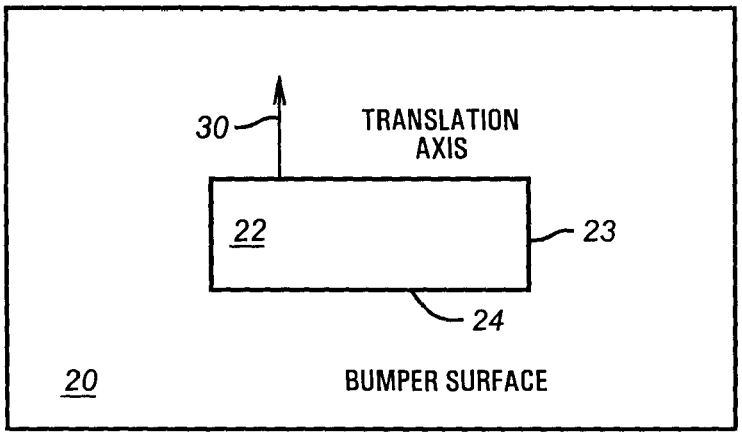

FIG. 3

Signed and Sealed this

Twenty-second Day of August, 2006

JON W. DUDAS
*Director of the United States Patent and Trademark Office*